US006889749B2

(12) United States Patent
Poloni et al.

(10) Patent No.: US 6,889,749 B2
(45) Date of Patent: May 10, 2005

(54) DEVICE TO DISCHARGE LIQUID STEEL FROM A CONTAINER TO A CRYSTALLIZER WITH ROLLERS

(75) Inventors: Alfredo Poloni, Fogliano di Redipuglia (IT); Nuredin Kapaj, Udine (IT)

(73) Assignee: Danieli & C. Officine Meccaniche SpA, Buttrio (IT)

( * ) Notice: Subject to any disclaimer, the term of this patent is extended or adjusted under 35 U.S.C. 154(b) by 0 days.

(21) Appl. No.: 10/474,833

(22) PCT Filed: Apr. 18, 2002

(86) PCT No.: PCT/IB02/01269

§ 371 (c)(1),
(2), (4) Date: Oct. 15, 2003

(87) PCT Pub. No.: WO02/085558

PCT Pub. Date: Oct. 31, 2002

(65) Prior Publication Data

US 2004/0123971 A1 Jul. 1, 2004

(30) Foreign Application Priority Data

Apr. 19, 2001 (IT) ..... UD2001A0075

(51) Int. Cl.[7] ..... B22D 11/06
(52) U.S. Cl. ..... 164/428; 164/437
(58) Field of Search ..... 164/428, 480, 164/437, 489

(56) References Cited

U.S. PATENT DOCUMENTS 3,867,978 A 2/1975 Johansson et al.
5,063,989 A * 11/1991 Powell et al. ..... 164/463
5,857,514 A * 1/1999 Shook et al. ..... 164/480
6,070,647 A * 6/2000 Folder et al. ..... 164/480
6,095,233 A 8/2000 Leabeater et al.

FOREIGN PATENT DOCUMENTS

EP 0850712 7/1998
JP 2055643 2/1990

* cited by examiner

*Primary Examiner*—Kiley S. Stoner
*Assistant Examiner*—I.-H. Lin
(74) *Attorney, Agent, or Firm*—Stevens, Davis, Miller & Mosher, LLP

(57) ABSTRACT

Device (10) to discharge liquid steel from a container (12) to a crystallizer (11) with rollers (31, 32), formed by a discharge element (13) arranged between the container (12) and the rollers (31, 32), wherein the discharge element (13) is shaped so as to define a main tank (15) provided with vertical intermediate walls (16, 18) which define a central compartment (19) into which the liquid steel is able to be cast from the container (12). Lateral walls (20, 21) define two lateral compartments (22, 23) communicating with the central compartment (19) by means of apertures (25) made in the lower part of the vertical intermediate walls (16, 18). On the bottom wall (27) of the discharge element (13), between the intermediate walls (16, 18) and the lateral walls (20, 21), discharge apertures (29) are provided through which the cast steel is able to flow downwards. Moreover guide elements (30) are provided at the sides of the discharge apertures (29).

18 Claims, 11 Drawing Sheets

DEVICE TO DISCHARGE LIQUID STEEL FROM A CONTAINER TO A CRYSTALLIZER WITH ROLLERS

CROSS-REFERENCE TO RELATED APPLICATION

This application is a 371 of PCT/IB02/01269 filed on Apr. 18, 2002.

FIELD OF THE INVENTION

The invention refers to a device to discharge the liquid steel contained in a container, consisting for example of a tundish, into the roller-type crystallizer of a continuous casting machine for strip. To be more exact, the discharge device is able to form a uniform meniscus between the rollers which define the crystallizer. Between the tundish and the discharge device an intermediate or secondary tundish can be arranged, in which the liquid steel arriving from the tundish is contained before being transferred to the roller-type crystallizer below.

BACKGROUND OF THE INVENTION

The state of the art includes continuous casting machines for steel strip, or similar products, wherein the crystallizer consists substantially of two rollers, which are arranged between lateral containing walls and rotate in opposite directions to convey the liquid steel downwards and thus form the cast product.

In such continuous casting machines, one of the main problems is the need to form, in the substantially V-shaped compartment which is created between the two rollers, a meniscus of liquid steel which is possibly uniform and homogeneous.

In the state of the art, the meniscus is usually formed with the help of a discharge device directly connected to the lower part of the tundish and provided with a lower end arranged either in proximity of the upper level of the meniscus or just below, that is to say, inside the meniscus.

In such conventional devices, there is no guarantee that the meniscus will be homogeneous and uniform, since the liquid steel is discharged directly into the bath which forms the meniscus, with the kinetic energy appropriate to the different level of the tundish and the crystallizer; the result is turbulence which has a negative affect especially in the zones of the meniscus wherein the contact occurs between the liquid steel and the rollers and/or the lateral containing plates.

U.S. Pat. No. 6,095,233 discloses a device to feed the steel between the rollers consisting essentially of a SEN (Submerged Entry Nozzle) shaped like an elongated trough and provided with holes or slits able to direct the flow of steel against the rollers, just under the meniscus. Between the upper tundish and the SEN there is a discharge element, whose section changes from circular to elongated, before it is inserted into the SEN. The main disadvantage of this known device is that the steel is fed onto the meniscus discontinuously, by means of the eyelets which are made on the lateral wall of the SEN. Consequently the feed of the liquid steel in the meniscus along the generatrix of the roller is not uniform.

U.S. Pat. No. 3,867,978 discloses a device to introduce steel into a mold for continuous casting, wherein the steel is discharged into a crystallizer by means of a SEN consisting of a submerged tube which ends in a plate elongated in the direction of the vertical casting axis. The plate on the one hand prevents the hot jet from hitting the solidifying skin and thus re-melting it, and on the other hand it feeds the meniscus. The SEN described in this known device, which does not use a roller-type crystallizer, is not able to feed the liquid steel along the meniscus in a uniform manner.

JP-A-02055643 discloses a device for the continuous casting of metal strip by means of a roller-type crystallizer, wherein a SEN is provided composed of a trough with inner walls substantially converging downwards and parallel to the lateral walls, and wherein on the lower part of the inner walls there are horizontal holes which allow the cast steel to pass into the lateral compartments of the SEN, between the inner walls and the lateral walls, to then be directed towards the meniscus above. This device has the following disadvantages: when there are high quantity flows of liquid steel it increases the turbulence thereof, because all the steel goes directly on the meniscus; it is not able to make the temperature of the liquid steel uniform in the liquid pool of the crystallizer, between the two rollers; it can create, under the SEN, a dead zone where the liquid steel stagnates and where inclusions can collect, which compromise the quality of the cast strip.

Applicant has devised and embodied this invention to overcome these shortcomings of the state of the art.

SUMMARY OF THE INVENTION

The device to discharge into the crystallizer with two rollers the liquid steel contained in a container, consisting for example of a tundish or an intermediate tundish, according to the invention is set forth and characterized in the main claim, while the dependent claims describe other innovative characteristics of the invention.

One purpose of the invention is to achieve a device to discharge liquid steel from a container into a crystallizer with two rollers which will guarantee mainly a uniform feed of the liquid steel in the zone of the meniscus, along the whole generatrix of the rollers, and also on the lateral containing plates.

In accordance with this purpose, the device according to the invention comprises a discharge element shaped so as to define a main tank provided with intermediate vertical or almost vertical walls, which define a central compartment, into which said liquid steel is able to be cast from the container, which, with the intermediate walls, define two lateral compartments communicating with the central compartment by means of apertures made in the lower part of the vertical intermediate walls.

On the bottom wall of the discharge element, between its intermediate walls and its lateral walls, discharge apertures are provided through which the cast steel is able to flow downwards. Advantageously, associated with said discharge apertures guide means are provided able to guide downwards at least a part of the liquid steel cast in the discharge element.

The guide means advantageously comprise guide fins.

The discharge apertures allow to obtain a series of advantages, including: to reduce the upward dynamic thrust and thus have less turbulence at the meniscus in the area of first solidification; to allow to make the temperature of the liquid uniform, preventing thermo-mechanical discontinuity (cracks); it prevents dead zones under the SEN and consequently possible inclusions from collecting which would then finish in the forming skin. The guide fins can be aligned with the bottom wall of the discharge element or they can extend downwards below the bottom wall, in order to direct the liquid better, far away from the forming skin.

The rollers of the crystallizer are arranged parallel to each other, at a defined distance "d", from each other, and define a substantially V-shaped upper space. The discharge element is located in this substantially V-shaped upper space and has a substantially rectangular longitudinal shape, with the larger sides parallel to the generatrixes of the containing rollers.

The lateral walls of the main tank are lower than the intermediate walls and define lateral passages for the liquid steel which thus goes to form a meniscus in the substantially V-shaped upper space.

The liquid steel is cast into the central compartment of the discharge element through a plurality of holes made in the lower part of the container above (tundish, intermediate tundish, or other type of container) in order to distribute the liquid steel in a uniform manner substantially along the whole length of the central compartment. Then, through the lower apertures of the intermediate walls, the steel substantially divides into two flows for each side: a first flow, once it has passed the corresponding lateral wall from above, is able to feed in a uniform manner the meniscus which is created in the afore-mentioned substantially V-shaped upper space, along the generatrixes of said rollers; and a second flow which is directed downwards through the afore-mentioned discharge apertures and goes directly under the discharge nozzle in order to make the temperature of the liquid steel uniform and to prevent the collection of inclusions. In this way we also obtain the advantage that the feed of liquid steel is all uniform, because the steel overflows uniformly over the outer wall of the discharge element and then goes to feed the meniscus.

The lateral walls of the discharge element are able to remain preferably a few millimeters below the level of the meniscus, thus ensuring a substantially flat meniscus without turbulence.

Such a uniform distribution of the liquid steel in the zone of the meniscus, along the generatrix of the rollers, ensures uniform heat exchange and uniform solidification, thus preventing cracks from occurring on the surface of the cast product.

Inside the central compartment of the discharge element there are elements able to reduce the kinetic energy of the liquid steel arriving from the tundish.

In a preferential form of embodiment, the liquid steel is fed towards the lateral containing plates by making it overflow from the front walls of the main tank, which are lower than the meniscus, in the same way in which the liquid steel overflows from the lateral walls of the discharge element.

According to a variant, there is a lateral tank, fed independently from the rest of the discharge element, made on the main container of the discharge element, in correspondence with each end. In this case, two outlet holes for the liquid steel are made on the lower part of the outer wall of the lateral tank.

BRIEF DESCRIPTION OF THE DRAWINGS

These and other characteristics of the invention will be apparent from the following description of some preferred forms of embodiment, given as a non-restrictive example with reference to the attached drawings wherein.

DETAILED DESCRIPTION OF PREFERRED EMBODIMENTS

Figure 1:
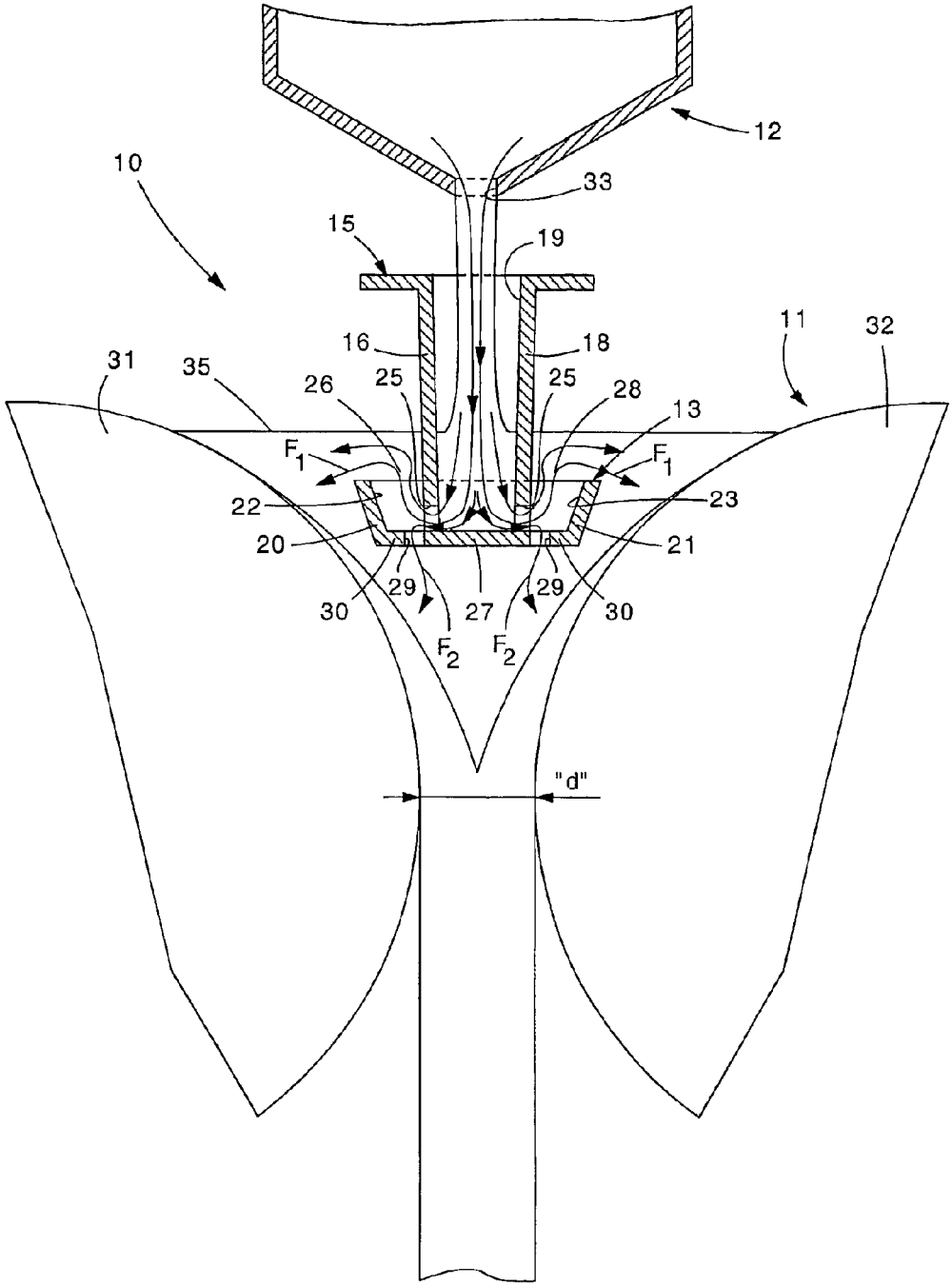
FIG. 1 is a cross section of a device to discharge liquid steel from a container to a crystallizer with two rollers according to the invention, in accordance with a first form of embodiment.

With reference to FIGS. 1, 2, 3, 4 and 5, a device 10 according to the invention to discharge the liquid steel contained in a container 12 into a crystallizer 11 of the type with two rollers 31 and 32, comprises a nozzle of the submerged type, or SEN, 13.

The container 12, arranged upstream of the crystallizer 11, is not essential for the purposes of the present invention and can comprise a conventional tundish, an intermediate tundish or any other type of container.

The SEN 13 is shaped so as to define a main tank 15, with a substantially rectangular longitudinal shape, provided with vertical intermediate walls 16 and 18 which define a central compartment 19 and lateral walls 20 and 21 which, with the vertical intermediate walls 16 and 18, define two lateral compartments 22 and 23 communicating with the central compartment 19 by means of apertures 25 made in the lower part of the vertical intermediate walls 16 and 18.

The lateral walls or wings 20 and 21 are lower than the vertical intermediate walls 16 and 18 and define lateral passages 26 and 28.

The SEN 13 is located in the substantially V-shaped space which is created between the two rollers 31 and 32 arranged parallel and at a defined distance "d" from each other; this distance "d" substantially defines the initial thickness of the cast product (for example a strip), emerging from the crystallizer 11.

On the bottom wall 27 of the SEN 13, between the intermediate walls 16, 18 and the lateral walls 20, 21, discharge apertures 29 are provided through which the cast steel is able to flow downwards. For some versions, guide fins 30 are provided at the sides of the discharge apertures 29.

Figure 2:
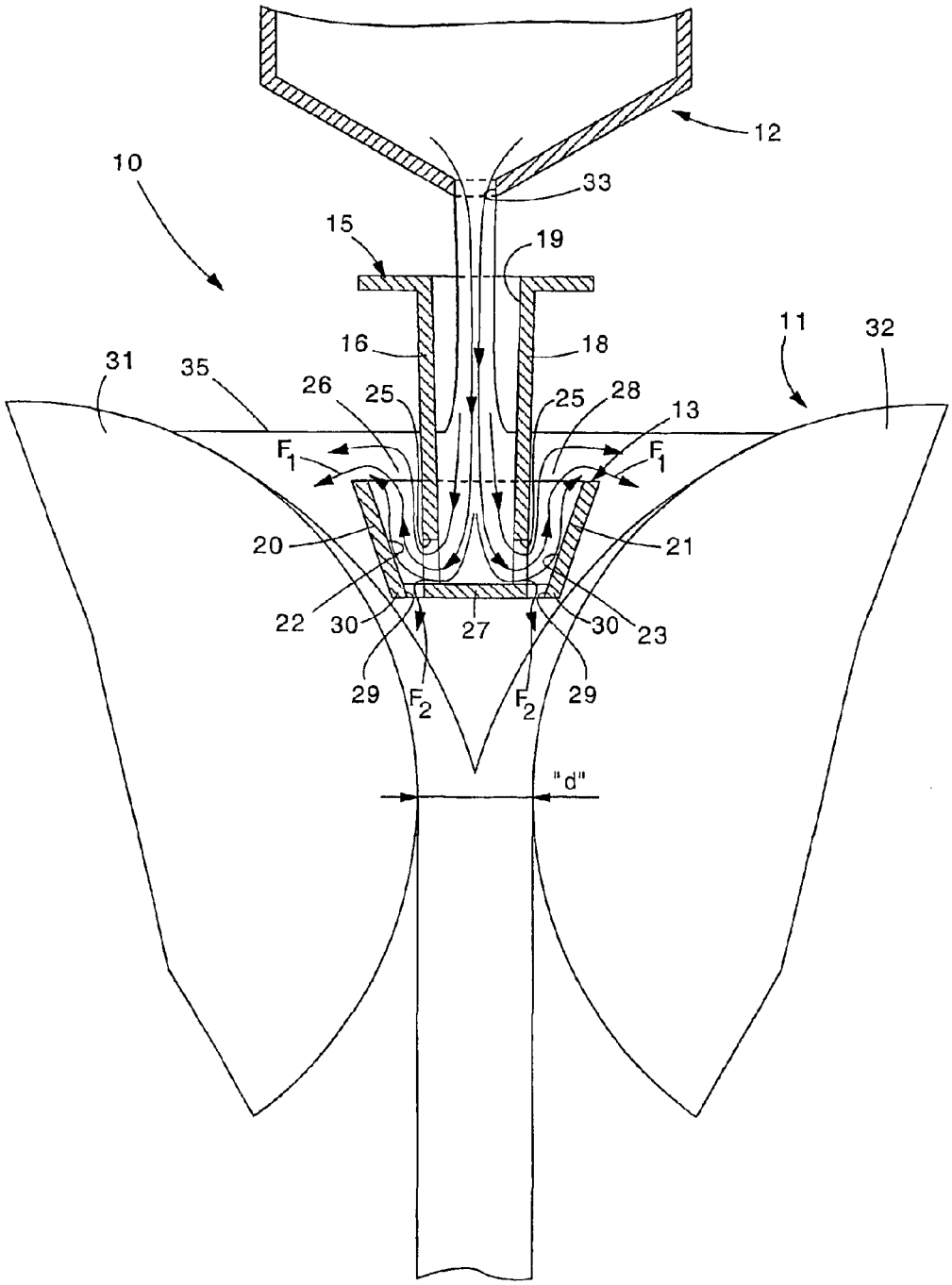
FIG. 2 is a cross section of a first variant of the device in FIG. 1.
Figure 3:
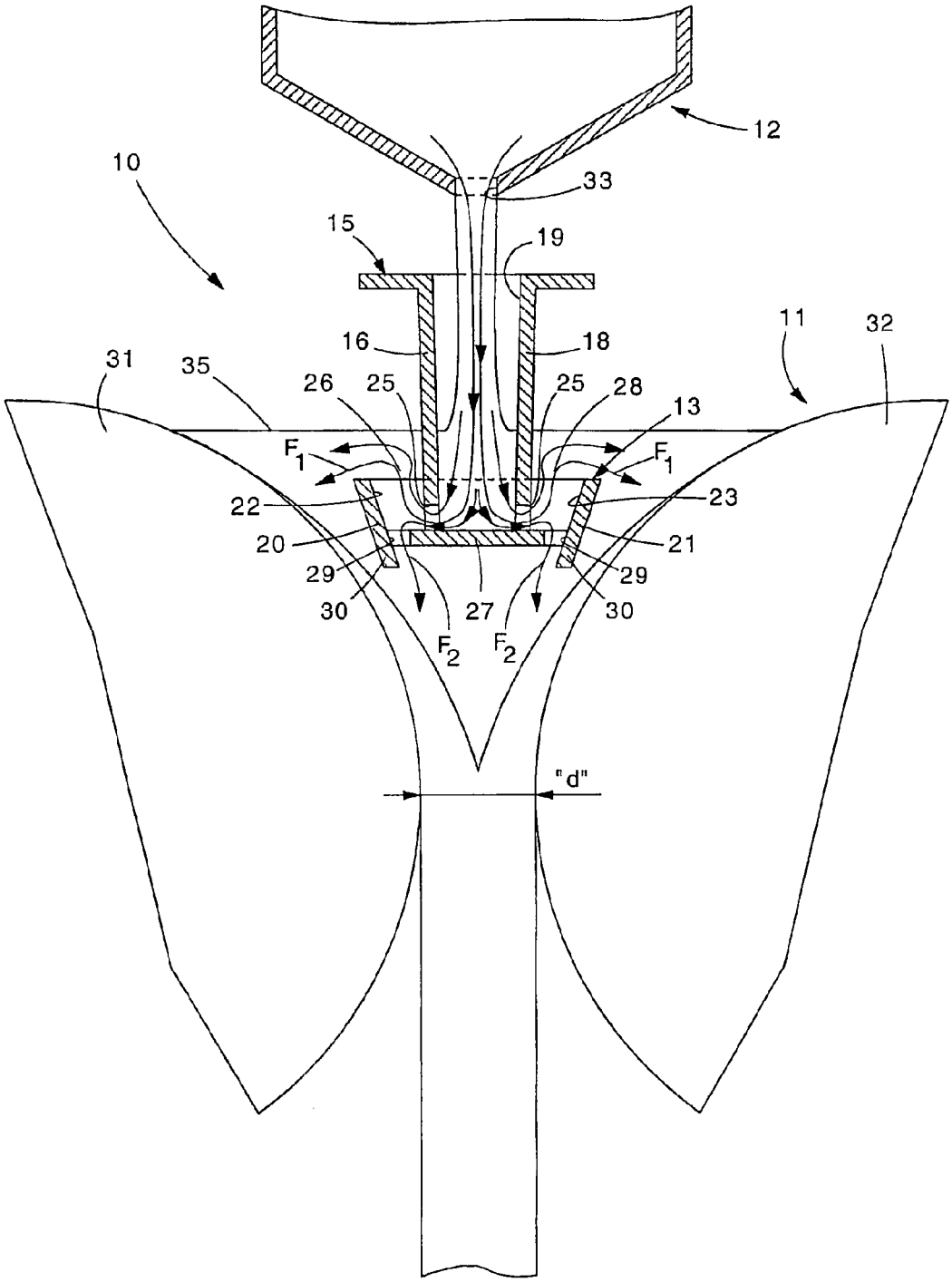
FIG. 3 is a cross section of a second variant of the device in FIG. 1.
Figure 4:
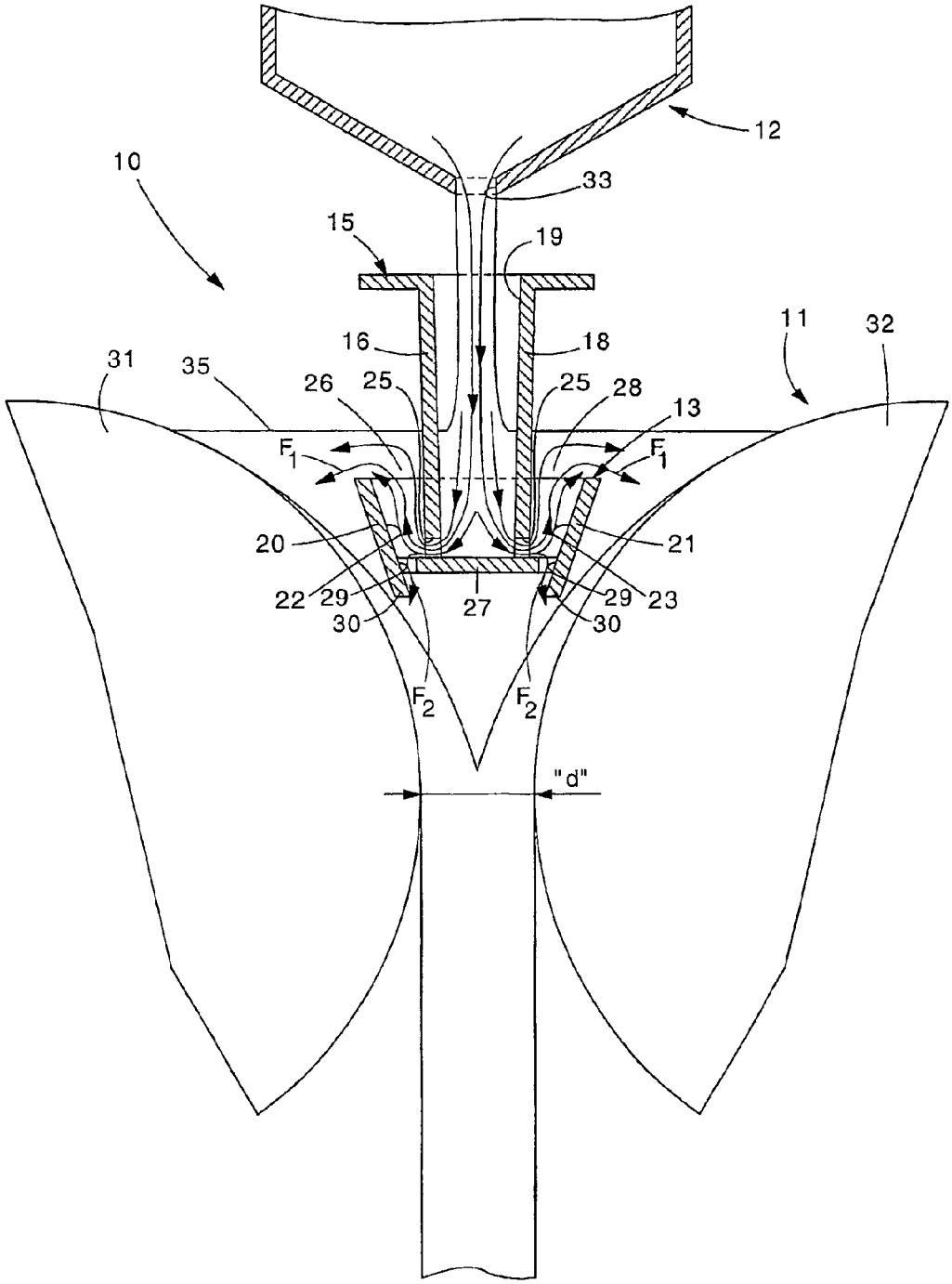
FIG. 4 is a cross section of a third variant of the device in FIG. 1.
Figure 5:
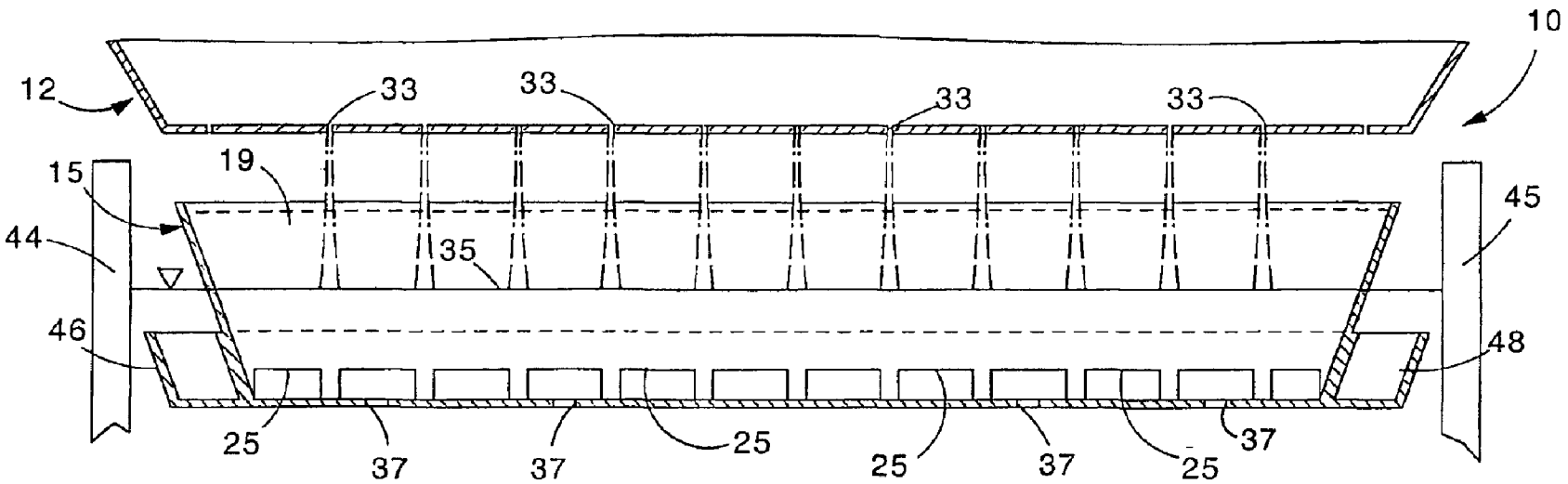
FIG. 5 is a longitudinal section of the device in FIG. 1.

The guide fins 30 can be made horizontal, as shown in FIG. 1, or vertical, as shown in FIGS. 2, 3 and 4.

The embodiment in FIG. 1 allows to reduce the upward dynamic thrust of the cast steel, so as to have less turbulence near the meniscus 35, in the area of first solidification, to make the temperature of the liquid uniform and prevent thermomechanical discontinuity (cracks), and also to prevent dead zones under the SEN and consequently possible inclusions from collecting which would then finish in the forming skin.

The container 12 is provided in its lower part with a plurality of holes 33, through which the liquid steel contained therein is able to be introduced into the central compartment 19 of the SEN 13. The holes 33 are uniformly distributed in correspondence with all the width of the crystallizer 11.

The liquid steel arriving from the container 12 is able to fill first the central compartment 19 and then, through the lower apertures 25, the lateral compartments 22 and 23 too. Once it has passed the lateral walls 20 and 21, the liquid steel goes to feed the meniscus 35 through the lateral passages 26 and 28, in uniform fashion, along the generatrixes of the rollers 31 and 32.

The lateral walls 20 and 21 are able to remain constantly at least a few millimeters, from about 2 to about 40 mm, preferably from about 10 to about 25 mm, below the level of the meniscus 35, thus ensuring that the meniscus is flat and without turbulence.

The lower apertures 25 can consist of eyelets, or one or more slits.

Figure 6:
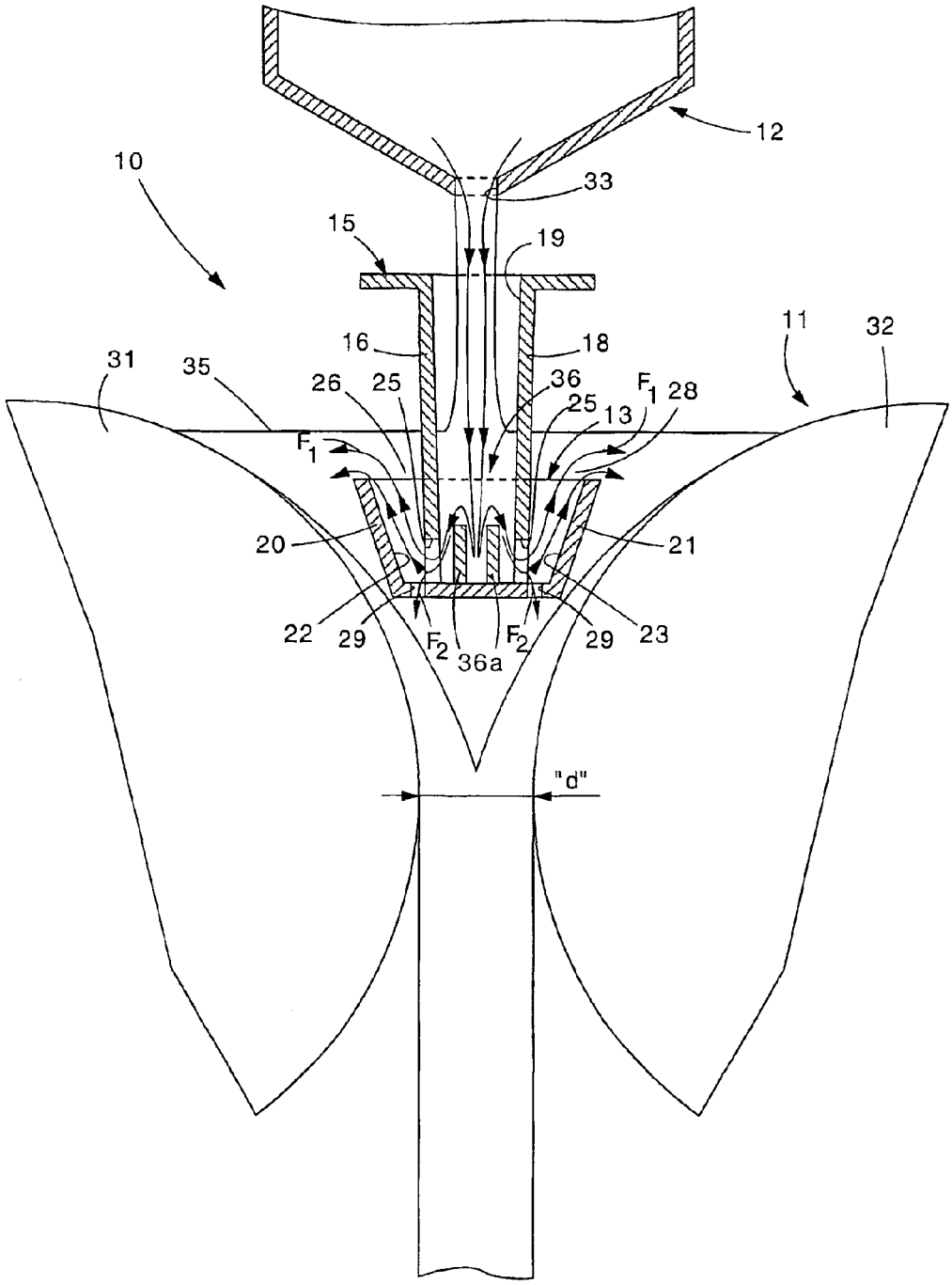
FIG. 6 is a cross section of a fourth variant of the device in FIG. 1.
Figure 7:
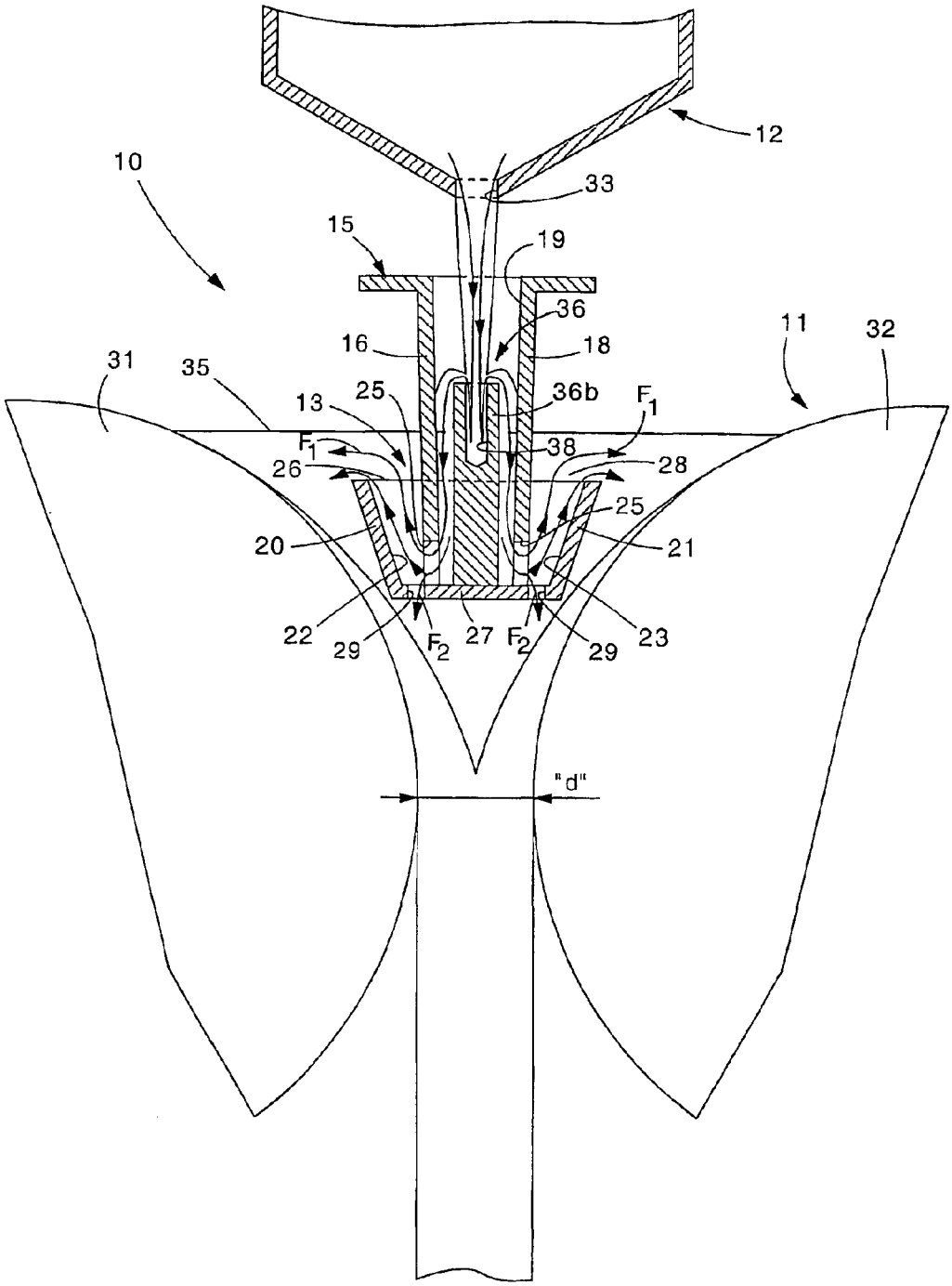
FIG. 7 is a cross section of a fifth variant of the device in FIG. 1.
Figure 8:
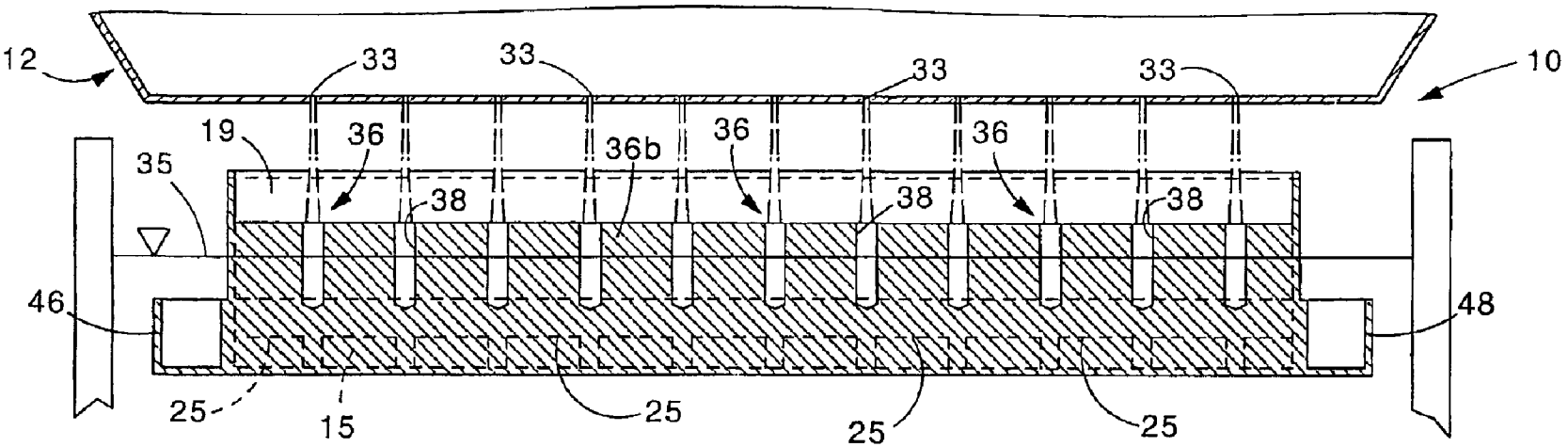
FIG. 8 is a longitudinal section of a detail of the device in FIG. 7.

Inside the central compartment 19 of the SEN 13 elements 36 (FIGS. 6, 7 and 8) can be arranged able to reduce the kinetic energy of the liquid steel arriving from the container 12. These elements 36, according to a first variant, can consist of two small vertical walls 36*a* (FIG. 6) arranged in the lower part of the central compartment 19 and higher than the apertures 25, or, according to a second variant, of a central wall 36*b* provided with central recesses 38 (FIGS. 7 and 8) arranged in correspondence with the holes 33 of the container 12.

The bottom of the main tank 15 is provided with a plurality of small holes 37 (FIG. 5), advantageously from three to five and having a diameter of between about 4 mm and about 6 mm, through which the liquid steel remaining in the tank 15 at the end of the casting cycle is able to emerge, to prevent the steel from solidifying therein.

In accordance with a preferential form of embodiment, as shown in FIGS. from 1 to 8, the liquid steel is fed towards the lateral containing plates 44 and 45 of the crystallizer 11 by making it overflow from the front walls 46, 48 of the main tank 15, which are lower than the meniscus 35, in the same way in which the liquid steel overflows from the lateral walls 20 and 21, at a speed such as to prevent it from solidifying when it arrives into contact with said containing plates 44 and 45, especially at the meeting point between one roller 31 or 32 of the crystallizer 11 with the relative lateral plate 44, respectively 45.

In accordance with a second form of embodiment, as shown in FIGS. from 9 to 13, the device 10 advantageously comprises two lateral tanks 39 and 40 located at the two opposite ends of the main tank 15. The lateral tanks 39 and 40 have the front walls 49 and 50 higher than the level of the meniscus 35 and are provided with lower apertures 42 and 43. To be more exact, on each front wall 49 and 50, in correspondence with the outer edges, there are two lower apertures 42, respectively 43, so that the liquid steel arrives at the so-called "triple point" in the meniscus, that is to say, the meeting point between each roller 31, 32 with the relative containing plate 44, respectively 45, on the plane of the meniscus 35. The liquid steel is able to emerge from said apertures 42, 43 at a sufficient speed so that it does not solidify. In one version, the lateral walls 20 and 21 of the main tank 15, as shown in FIGS. 9 and 10, extend as far as the front walls 49 and 50 of the lateral tanks 39 and 40, so that the liquid steel overflows along the whole length of the tank 15, substantially as far as the lateral ends of the rollers 31 and 32.

Figure 11:
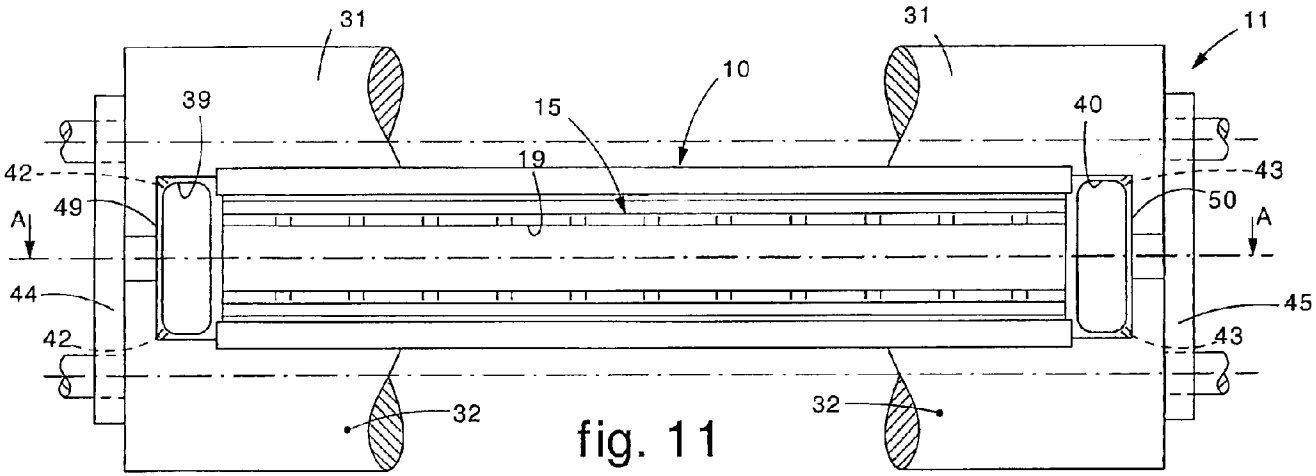
FIG. 11 is a view from above of a variant of the device in FIG. 9.
Figure 12:
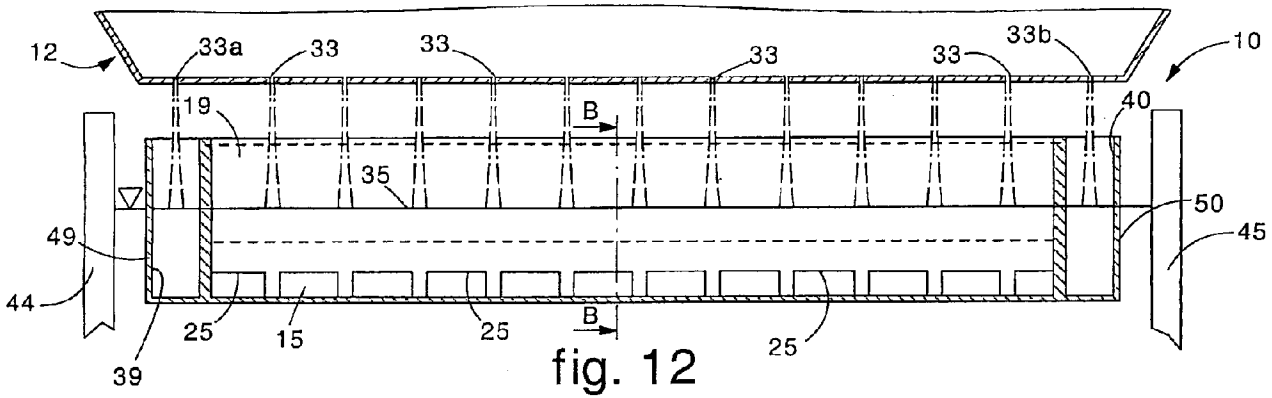
FIG. 12 is a longitudinal section along the line from A to A in FIG. 11.
Figure 13:
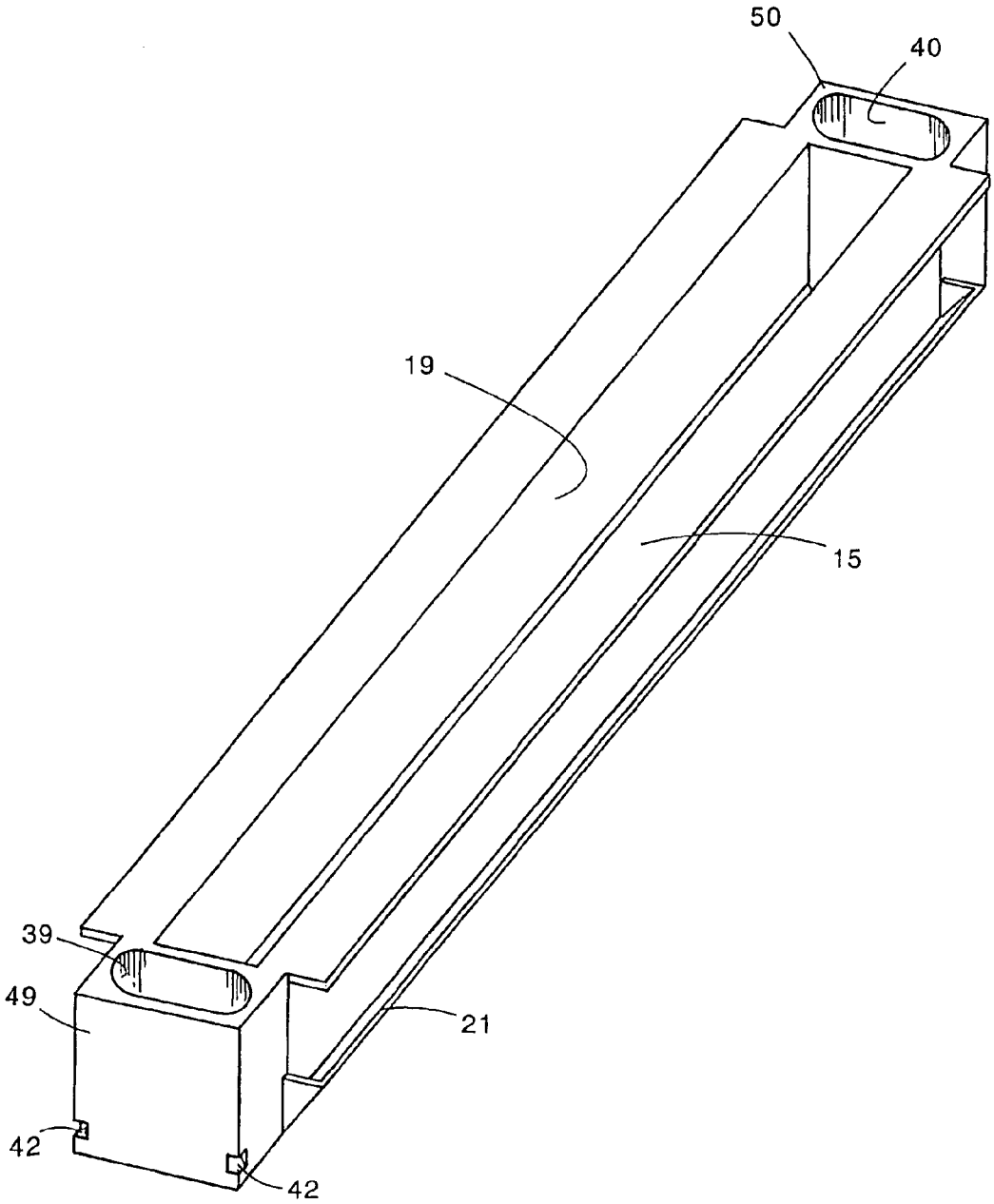
FIG. 13 is a prospective view of a detail of the device in FIG. 11.

According to a variant, shown in FIGS. 11, 12 and 13, the lateral walls 20 and 21 are as long as the central compartment 19 and do not extend as far as the front walls 49 and 50 of the lateral tanks 39 and 40, so that the liquid steel stops overflowing before the lateral ends of the rollers 31 and 32.

Figure 9:
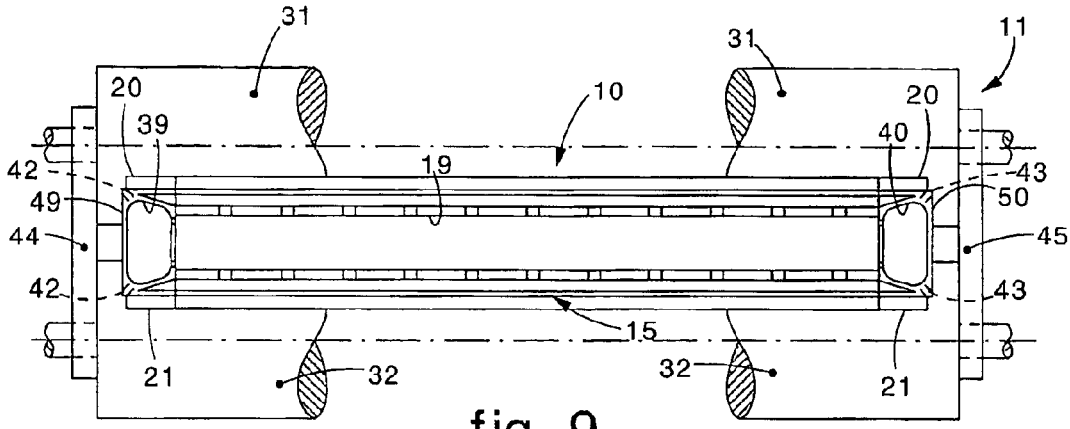
FIG. 9 is a view from above of a device according to the invention, in accordance with a second form of embodiment.
Figure 10:
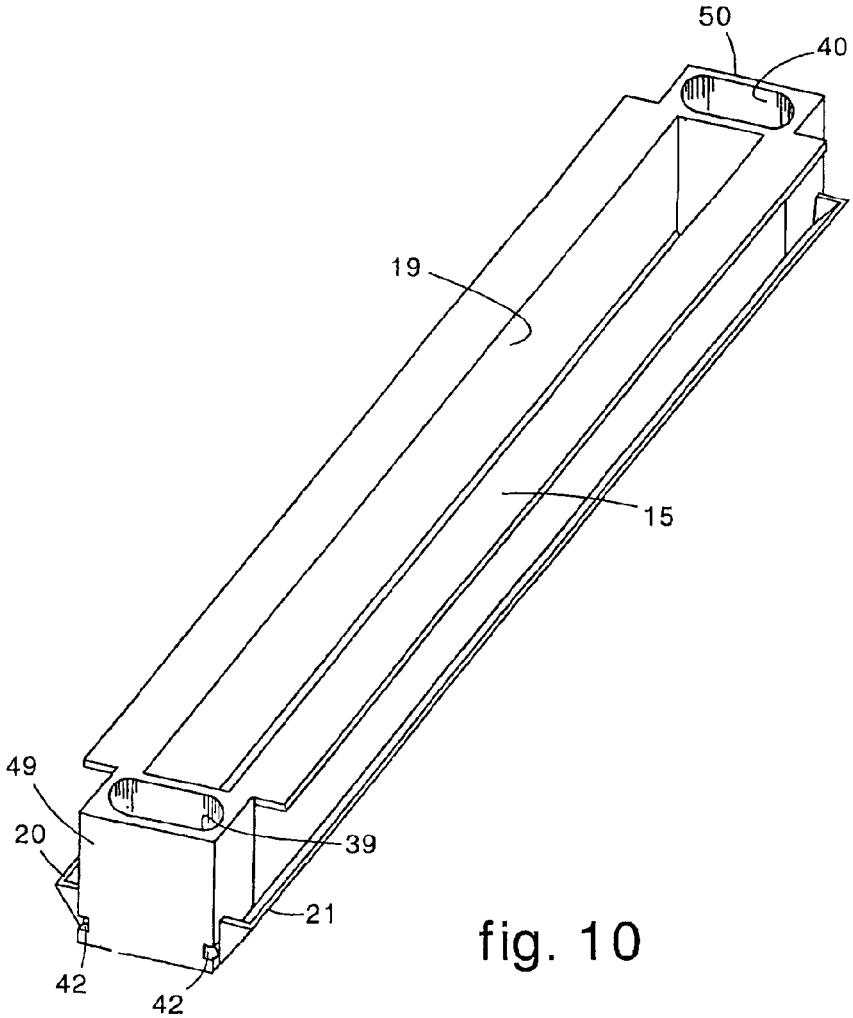
FIG. 10 is a prospective view of a detail of the device in FIG. 9.

Both in the embodiment shown in FIGS. 9 and 10, and also in the variant shown in FIGS. 11, 12 and 13, the lateral tanks 39 and 40 are fed autonomously with respect to the main compartment 19, through corresponding gauged holes 33*a*, 33*b* of the container 12.

The speed at which the liquid steel exits from the lateral apertures 42 and 43 can be controlled for example by regulating the level of the liquid which is created in the lateral tanks 39 and 40 and the diameter of the holes 42 and 43.

It is clear that modifications or additions may be made to the device 10 as described heretofore, without departing from the spirit and scope of the invention.

It is also clear that, although the invention has been described with reference to some specific examples, a person of skill in the art shall certainly be able to achieve many other forms of equivalent devices, all of which shall come within the field of the invention.

What is claimed is:

1. A discharge device to discharge liquid steel from a container to a crystallizer having two rollers, the discharge device comprising:

a discharge element arranged between said container and said rollers, wherein said discharge element is shaped to define a main tank comprising two substantially vertical intermediate walls which define a central compartment into which said liquid steel is able to be cast from said container, two lateral walls which, with said intermediate walls, define two lateral compartments communicating with said central compartment by apertures made in the lower part of said substantially vertical intermediate walls, and a bottom wall, wherein said bottom wall has, in a position between the prolongement of said intermediate walls and said lateral walls, discharge apertures for flowing a first portion of the cast steel downwards into the crystallizer, and guide means provided at the sides of said discharge apertures to guide a second portion of the cast steel towards said lateral compartments to have said second portion of the cast steel discharged from above said lateral walls into the crystallizer along the generatrixes of said rollers.

2. Device as in claim 1, wherein said guide means comprise fins which extend downwards below said bottom wall.

3. Device as in claim 2, wherein said device is configured for liquid steel arriving from said container being able to fill first said central compartment and then, through said lower apertures, able to fill said lateral compartments, said liquid steel being then able to divide into a first flow which, once the first flow has passed said lateral walls from above, is able to feed, through lateral passages and in uniform fashion, a meniscus which is created in a substantially V-shaped upper space, along the generatrixes of said rollers, and into a second flow which is directed downwards through said discharge apertures.

4. Device as in claim 3, wherein said lateral walls are able to remain constantly at least a few millimeters, from about 2 mm to about 40 mm below the level of said meniscus, thus ensuring a flat meniscus, without turbulence.

5. Device as in claim 3, wherein said main tank comprises two front walls, lower than said meniscus, and the liquid steel is fed from said main tank towards two containing plates of said crystallizer by making the liquid steel overflow from said front walls in the same way in which the liquid steel overflows from said lateral walls at a speed such as to prevent the liquid steel from solidifying when the liquid steel comes into contact with said lateral containing plates.

6. Device as in claim 3, further comprising two lateral tanks located at two opposite ends of said main tank, wherein said lateral tanks comprise front walls which are higher than the level of said meniscus and provided with lower apertures for discharging the liquid steel laterally, towards the "triple point" zone wherein each lateral end of said rollers meets the relative containing plate on the plane of said meniscus, at a sufficient speed so that the liquid steel does not solidify, said lateral walls extending as far as said front walls so that said liquid steel overflows substantially along the whole length of said tank, as far as the lateral ends of said rollers.

7. Device as in claim 6, wherein said lateral tanks are fed autonomously with respect to said main compartment.

8. Device as in claim 6, wherein the speed at which the liquid steel emerges from said lower apertures is controlled by regulating the level of the liquid which is created in said lateral tanks and the diameter of said lower apertures.

9. Device as in claim 3, further comprising two lateral tanks located at two opposite ends of said main tank, wherein said lateral tanks comprise front walls which are higher than the level of said meniscus and are provided with lower apertures for discharging the liquid steel laterally, towards the "triple point" zone wherein each lateral end of said rollers meets the relative containing plate on the plane of said meniscus, at a sufficient speed so that the liquid steel does not solidify, and said lateral walls are as long as said central compartment, so that the liquid steel stops overflowing before the lateral ends of said rollers.

10. Device as in claim 9, wherein said lateral tanks are fed autonomously with respect to said main compartment.

11. Device as in claim 3, wherein said lateral walls are able to remain constantly at least a few millimeters from about 10 mm to about 25 mm below the level of said meniscus, thus ensuring a flat meniscus, without turbulence.

12. Device as in claim 1, wherein said lower apertures and said discharge apertures consist of eyelets.

13. Device as in claim 1, wherein said lower apertures and said discharge apertures consist of one or more slits.

14. Device as in claim 1, wherein inside said central compartment there are elements able to reduce the kinetic energy of said liquid steel arriving from said container.

15. Device as in claim 14, wherein said elements comprise small vertical walls arranged in the lower part of said central compartment.

16. Device as in claim 14, wherein said elements comprise a central wall provided with central recesses.

17. Device as in claim 1, wherein the bottom of said main tank is provided with a plurality of holes through which residual liquid steel, present in said main tank at the end of the casting cycle, is able to emerge, to prevent the steel from solidifying inside said tank.

18. Device as in claim 1, further comprising two lateral tanks located at two opposite ends of said main tank.

* * * * *